US005131868A

United States Patent [19]

Forterre

[11] Patent Number: 5,131,868

[45] Date of Patent: Jul. 21, 1992

[54] POWER DISTRIBUTING DEVICE COMPRISING A SUPPORTING BODY CARRYING A NUMBER OF COAXIAL CONNECTORS OF DIFFERENT SIZES AND METHOD OF ASSEMBLING SAME

[75] Inventor: Gérard E. E. Forterre, Colombes, France

[73] Assignee: Tekelec Airtronic, France

[21] Appl. No.: 669,871

[22] Filed: Mar. 14, 1991

[30] Foreign Application Priority Data

Apr. 24, 1990 [FR] France ..... 90 05219

[51] Int. Cl.[5] ..... H01R 17/04

[52] U.S. Cl. ..... 439/582; 439/650

[58] Field of Search ..... 29/842, 843, 854; 439/578-585, 675, 874, 650, 651; 333/245, 246, 260, 261

[56] References Cited

U.S. PATENT DOCUMENTS

| | | | |
|---|---|---|---|
| 2,813,144 | 11/1957 | Valach | 439/579 |
| 3,528,052 | 9/1970 | Brishka | 439/582 |
| 4,049,902 | 9/1977 | deRonde | 439/582 |
| 4,655,534 | 4/1987 | Stursa | 439/582 |
| 4,797,121 | 1/1989 | Hayward | 439/579 |
| 4,881,912 | 11/1989 | Thommen et al. | 439/585 |

FOREIGN PATENT DOCUMENTS

| | | | |
|---|---|---|---|
| 1035699 | 8/1983 | U.S.S.R. | 439/582 |
| 2183111 | 5/1987 | United Kingdom . | |

*Primary Examiner*—David Pirlot

*Attorney, Agent, or Firm*—Ostrolenk, Faber, Gerb & Soffen

[57] ABSTRACT

A power distributor device comprising a metal body for supporting a number of coaxial connectors of various dimensions, wherein the inner end of the pin of one connector of greater size exhibits a central recess into which are opening holes extending through the side wall of the recess and adapted to receive the inner ends of the pins of the other connectors, the recess communicating with the outside through a passage-way in the wall of the supporting body which permits the insertion into said recess of a means for electrically connecting said inner ends of the pins of the whole of the connectors, the invention being usable with multicoupling elements.

11 Claims, 3 Drawing Sheets

II
III
IV
V
V
1
2
4
5
6
7
10
11
12
13
13
15
16
17
18
20
20
22
23
23
24
25
25
26
27
27
28
29
29
30
30
32
34
35

VII
VII
4
5
6
7
7
11
15
15
16
16
17
17
18
20
20
20
22
23
30
37
40
41
43
43
44
44
45
45
46

POWER DISTRIBUTING DEVICE COMPRISING A SUPPORTING BODY CARRYING A NUMBER OF COAXIAL CONNECTORS OF DIFFERENT SIZES AND METHOD OF ASSEMBLING SAME

BACKGROUND OF THE INVENTION

The invention relates to a power distributing device of the type comprising a supporting metal body carrying a number of coaxial input and output connectors of different sizes and each one comprising an outer socket element which may be secured onto the supporting body and inner pin element coaxial with the socket element and retained within the latter by a ring made from an electrically insulating material, the supporting body comprising an inner space communicating with the outside through passage-ways for the connector pins, the inner ends of which are electrically connected to the inside of the inner space. The invention relates also to a method of mounting the coaxial connectors onto the said supporting body.

Power distributing devices of this kind are already known. They generally comprise two to four orthogonal access ways and an output way. The making of such distributors is very difficult applications where it is desirable to have the same electric length between the different access ways and the output way while avoiding intermodulation effects.

Heretofore it has not been possible to manufacture power distributors likely to comply with these reqirements in a quick and simple manner.

SUMMARY OF THE INVENTION

An object of the present invention is to provide a distributor device of a simple structure which may be assembled quickly and easily while providing the same electric length between the acess ways and the output way.

For reaching this goal the power distributor device according to the invention is characterized in that the inner end of the pin of one connector of greater dimensions exhibits a central recess into which opening holes are provided which extend through a side wall of the recess and are adapted to receive the inner ends of the pins of the other connectors, the recess communicating with the ouside through a passage-way within the wall of the supporting body permitting the insertion into the recess of a means for the electric connection of the inner ends of the pins of the whole of the connectors.

According to an advantageous feature of the invention, the supporting body exhibits a parallelepipedic shape and the connectors are each fastened onto one of the outer faces of the body while being arranged orthogonally with respect to each other, the holes for receiving the pins being formed of bores extending at right angles to the center line axis of the receiving pin and intersecting on the axis of the aforesaid recess.

According to another advantageous feature of the invention, the aforesaid recess is formed of a blind axial hole provided in the front face of the inner end of the receiving pin and the passage-way for the insertion of the means for the connection of the ends of the pins is formed of a bore provided in that face of the supporting body which is located axially in front of the blind hole.

According to still another advantageous feature of the invention, the connecting means inserting bore may be closed by a screw, the penetration dept of which is adjustable and forms a means for the adjustment of the electric length of the inner ways of the distributor.

The method of assembling a power distributing device according to the invention is characterized by the steps of inserting into the recess receiving the pin accomodating the pins of the other connectors a mounting rod, the diameter of which is slightly smaller than the diameter of the recess, fitting the ends of the other pins into the receiving holes to cause them to be in abutment against the side surface of the rod, securing the pins in this position, inserting a welding means through the aforesaid passage-way and closing this passage-way by means of the screw.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non limiting example only illustrating several embodiments of the invention and wherein.

DETAILED DESCRIPTION

Figures 1, 4, 5:
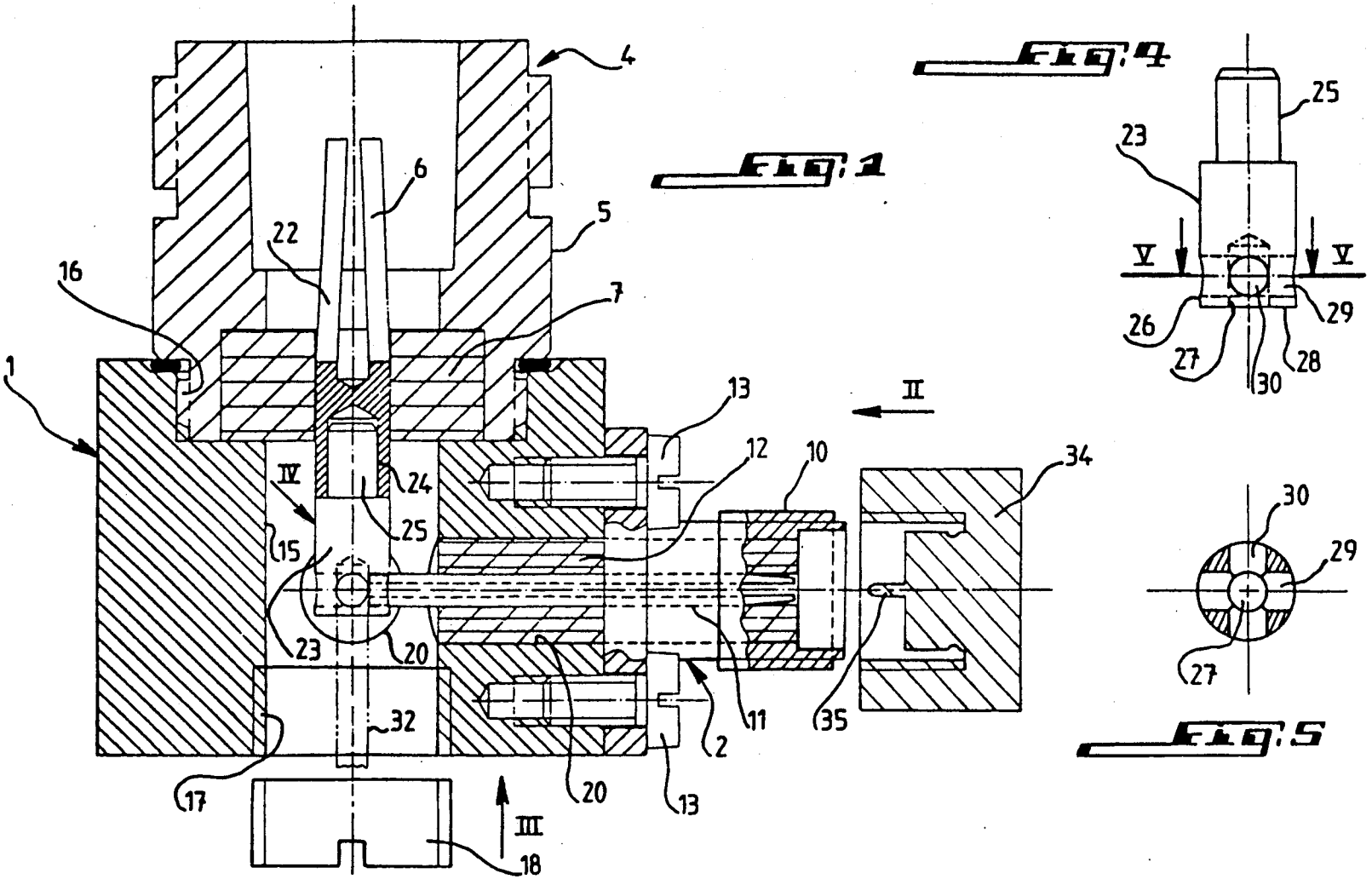
FIG. 1 is a view in section taken upon the line I—I of FIG. 3 and showing a first embodiment of a power distributing device according to the present invention.
FIG. 4 is a detail view of the inner part shown by the arrow IV of FIG. 1.
FIG. 5 is a view in cross-section taken upon the line V—V of FIG. 4.
Figure 3:
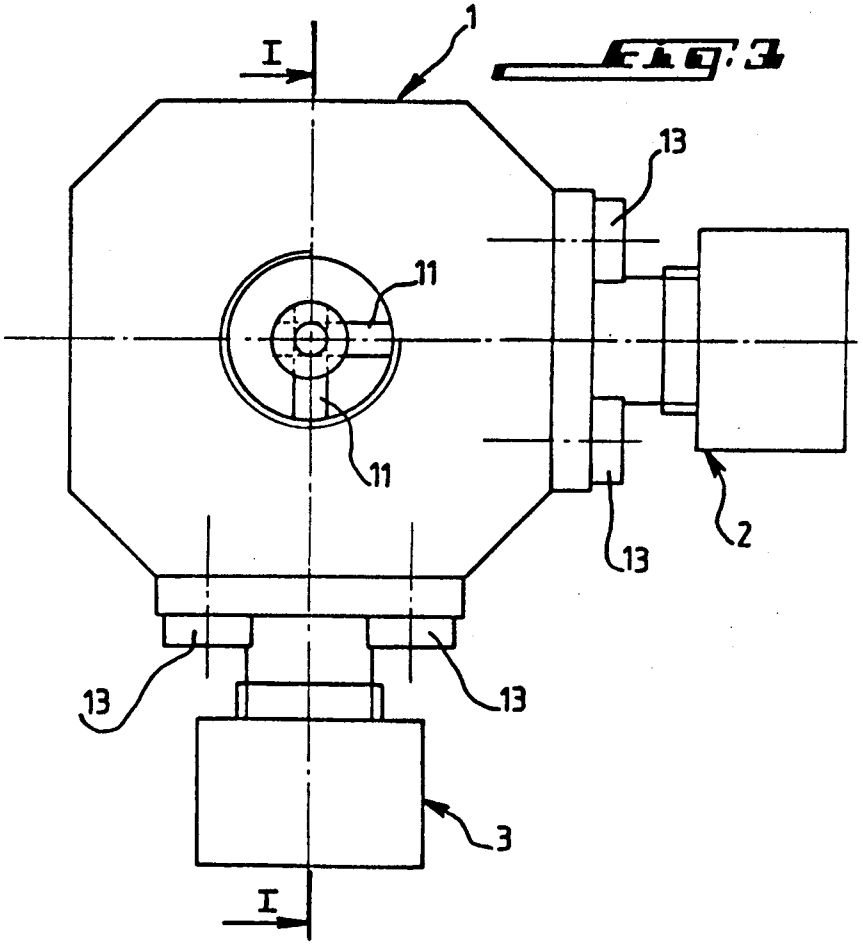
FIG. 3 is a view seen in the direction of the arrow III of FIG. 1.

FIG. 1 shows by way of example a power distributor device which comprises a supporting body 1 adapted to carry three coaxial female connectors, namely two access connectors 2, 3 (see FIG. 3) of smaller dimensions and an output connector 4 of larger dimensions. These connectors are orthogonally mounted within the supporting body 1. The latter is of parallelepipedic shape and the connectors are each secured on one of its outer sides or faces.

The connector 5 is of standard shape known per se and comprises a socket-shaped outer element 5 and a pin-like inner element 6 which ius coaxial with the socket element 5 and is retained within the latter by a cylindrical ring 7 made from an electrically insulating material such as teflon, for instance. The pin 6 is force-fitted into a suitable axial hole of the plug 7. The socket element 5 is fastened as by screwing to the body 1. Both connectors 2, 3 which are of the same kind and also per se each comprise an outer sleeve element 10 in which is coaxially mounted a pin element 11 retained with the sleeve 10 by a cylindrical ring or bushing 12 made from an electrically insulating material such as teflon. The connectors 2 and 3 are each fastened onto one face or side of the supporting block or holder 1 by means of four screws 13.

Through the body 1 fully extends in the axial direction of the connector 4 a cylindrical bore 15 which comprises at one end an internally threaded annular recess 16 adapted to receive the connector 4. The other end 17 of the bore 15 is threaded also and is adapted to receive a screw 18, the function of which will be described later. As shown in FIG. 1, the pin 6 of the connector 4 extends axially into the space defined in the bore 15 by the ring 7 of the connector and the screw 18. Each wall of the supporting block or holder 1, the outside face of which carries a connector 2, 3, is formed of a cylindrical bore 20 drilled or pierced therethrough, through which the pin 11 of the connector extends into the inner space of the body 1, the bore feing closed by the insulating cylindrical member 12 made from teflon.

Figure 2:
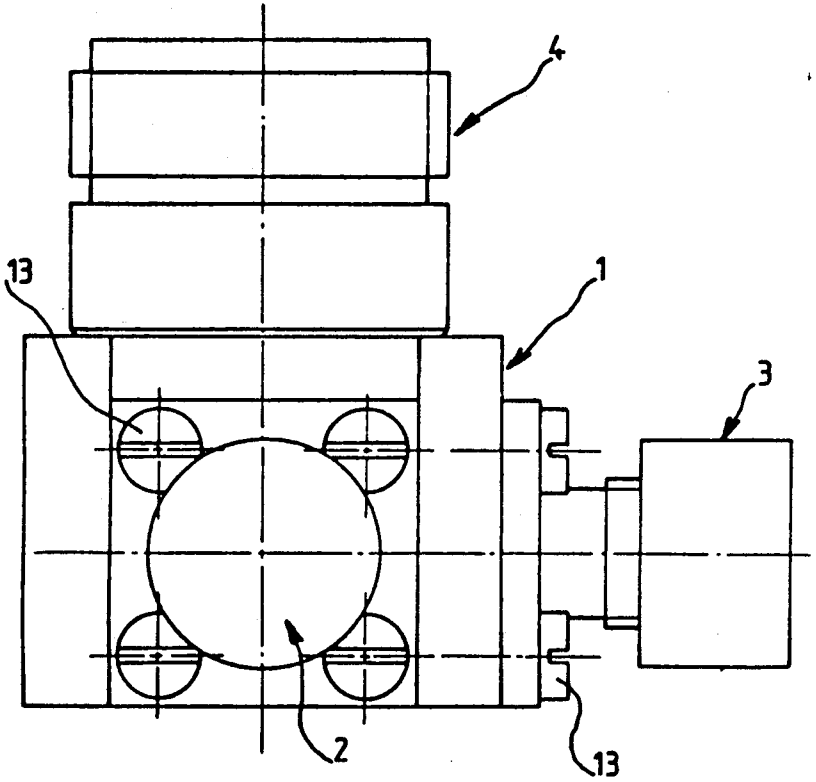
FIG. 2 is a view seen in the direction of the arrow II of FIG. 1.

According to the embodiment shown, the pin 6 consists of two axially aligned parts, namely, an outer toung-shaped tubular part 22 adapted to receive the pin of a male connector (not shown), and an inner part 23 which is fitted into an axial blind hole 24 formed within the axially inner end of the part 22 with a cylindrical axial end stud 25. As clearly shown in FIGS. 2 and 3, the end portion 26 of the plug 23 exhibits and axial blind hole 27 opening into the front face 28 and two bores 29, 30 which extend perpendicularly through the end 26 at some distance from the face 28 and are crossing or intersecting at the blind hole 27. The diameters of the bores 29 and 30 are slightly greater than the diameters of the pins 11 so that they may engage these bores. As shown in FIG. 1, in the assembled condition of the distributor, each pin 11 of a connector extends into a bore 29, 30 down to the level of the blind hole 27 and the electrical connection of the pins 6 and 11 of the three connectors is provided by welding or soldering by means of a welding or soldering agent inserted into the hole 27 through the open end 17 of the bore 15 of the supporting body 1 which is molten or fused by means of a soldering iron or bit or welding means also inserted through the open end 17 of this bore. When entering and filling the blind hole 27 and the adjacent portions of the bores 29, 30, the welding or soldering agent provides for a perfect electrical connection of the pins. After the connection operating step, the open end 17 of the bore 15 is closed by inserting the screw 18 therein.

To provide for the proper, accurate and perfectly reproducible positioning of the inner ends of the various pins to be electrically connected, a mounting rod or stick 32 shown in dash-dotted lines in FIG. 1 is used for the assembling step. This rod or stick exhibits a diameter slightly smaller than the diameter of the blind axial hole 27 so as to insertable into this hole through the open end 17 of the bore 15 at the start of the assembling of the distributor subsequently to the mounting onto the supporting body 1 of the connector 4. Then the pins 11 of the connectors 2 and 3 are axially pushed or driven inwards of the inner space of the body 1 until the ends of these pins enter the corresponding bores 29, 30, respectively, in the end of the pin 6 and are caused to abut the peripheral surface of the mounitng stick or rod 32 inserted into the blind hole 27, the outer sleeve elements 10 of the connectors having been previously fastened onto the supporting body 1. For keeping the pins 11 in this position illustrated. FIG. 1, there is screwed onto each of the connectors 2 and 3 an auxiliary mounting member 34 which is provided with a central axial stud portion 35 arranged so as to be engageable with the outer end of the pin while retaining the latter in position axially as well as radially. Then the mounitng rod 32 is withdrawn and the inner ends of the three pins 6 and 11 are assembled together by means of a conventional solder ar eutectic welding agent such as tin, for instance, and of a soldering iron or bit which is inserted through the open end 17. After having thus carried out the electrical connector of the pins, the screw 18 is inserted into the end 17 down to the desired depth. By adjusting the dept of penetration of the screw, it is possible to vary the capacitance established between the inner face of the screw and the junction of the pins, which is equivalent to a variation in the electric lengths of the ways inside of the distributor. The screw may be fastened as by welding, for instance, in its adjusted position.

Figures 6, 7, 8:
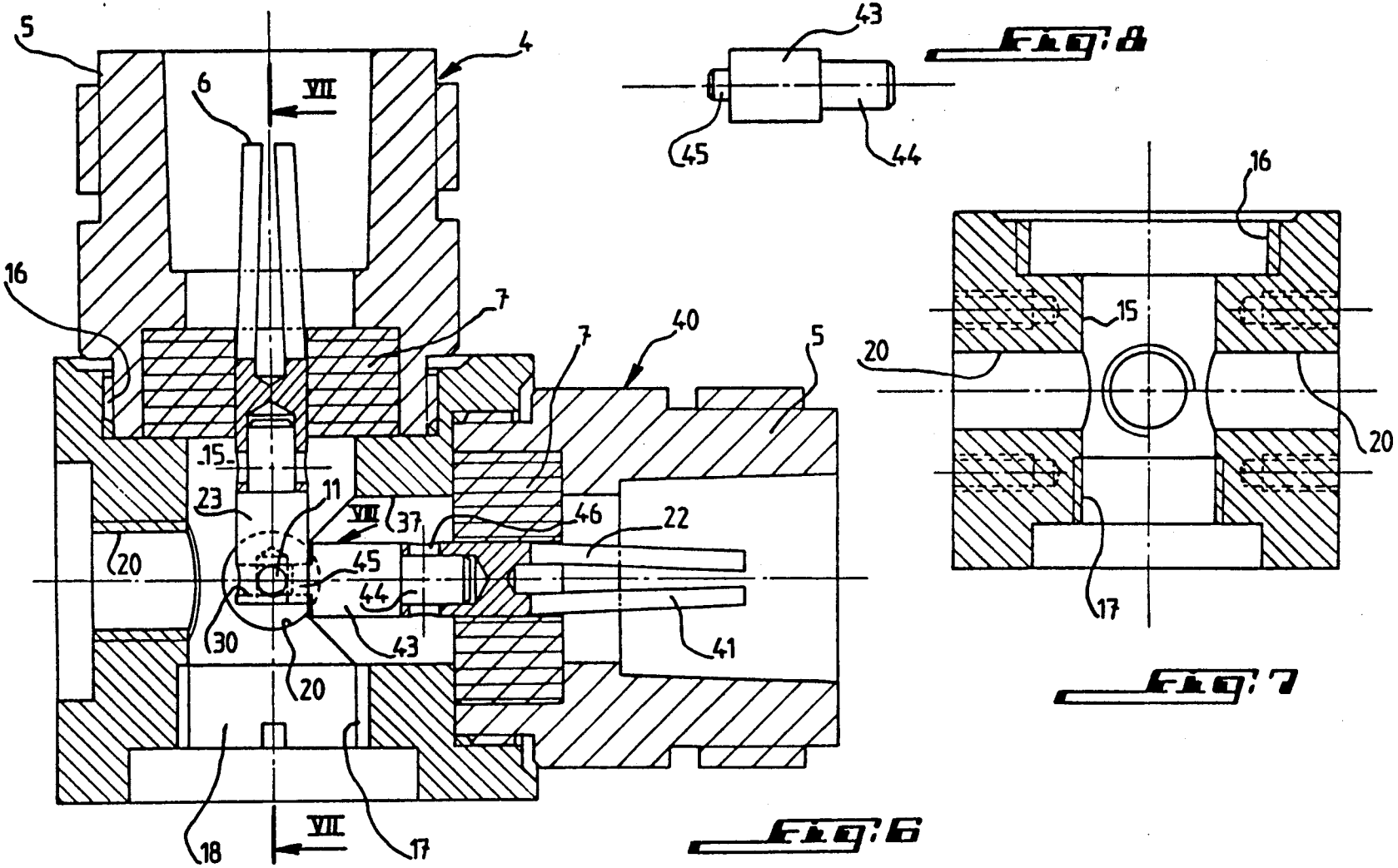
FIG. 6 is a sectional view similar to FIG. 1 showing a second embodiment of the distributor device according to the invention.
FIG. 7 is a view in section taken upon the line VII—VII of the supporting block 1 of FIG. 6.
FIG. 8 is a detail view of the part shown by the arrow VIII of FIG. 6.

FIGS. 6 to 8 show a second embodiment of a power distibutor device according to the present invention. In these Figures, the same reference numerals for like or similar parts or elements are used or in embosiment of FIGS. 1 to 5.

The distributor according to FIGS. 6 to 8 comprises two connector 4, 40 of greater sizes and two connectors 2, 3 of smaller sizes, all four of which are arranged orthogonally. Unlike the supporting body 1 according to FIG. 1, the body 1 of the second embodiment comprises in confronting relationship with the bore 24 forming the passage-way for the pin 11 of a connector 2, 3, a bore 37, the diameter of which corresponds to that of the bore 15 and which is adapted to form the passage-way of the pin 41 of the second connector 40. The pin 41 consists of two axially aligned parts assembled through axial fitting, namely, one part identical with the outer part 22 and one axially inner part 43 which comprises an axial cylindrical end stud portion 44 adapted to engage the axial blind hole 24 of the part 22, and at the opposite end a cylindrical axial end portion 45, the diameter of which is the same as the diameters of the pins 11 of the connectors 2, 3. Upon assembling the power distributor, the pin 41 of the connector 40 engages with its end portion 45 the corresponding bore 29 or 30 of the pin 6 of the connector 4 and is connector therein to the ends of the other pins in the fashion already described hereabove with reference to the first embodiment. It is further seen that the axially outer part 22 of the pin 41 exhibits at its blind axial bore 24 a transverse hole 46 premitting making both parts 42 and 43 of the pin 41 fast to each other as by welding or soldering for instance.

It should be understood that various modifications may be made to the embodiments of the invention which have just been described without departing from the scope of the invention. Thus the number of the orthogonally arranged connectors may be different. In the case of the supporting body of paallelepipedic shape it sould be possible to provide four connectors about the receiving pin, namely one on each available face. It should be pointed out that the pins 6 and 41 of the connectors of larger sizes may be made as an intregral part. Various configurations of the supporting body and of the pins may be contemplated and it matters only that the inner end of the pin receiving the other pins exhibit bores and holes for the accommodation of the other pins and the positioning and the connectors of the ends of the pins engaging the pin of the support.

It appears from the desription of the structure of the distributor device according to the invention and from its method of assembling that the invention perfectly attains the goal aimed at and stated hereinabove, namely the quick, cheap and accurately reproducible provision of a power distributor with a simple construction while providing for the same electric length between the acces ways and the output ways(s) while avoiding any intermodulation effect whatsoever. The distributor has a compact structure. All the ways are phase-balance to an accuracry better than 0.5° at a frequency of 1 GHz. The connection of the pins is performed by controlled welding, permitting the use of a high power.

What is claimed is:

1. A power distributor device for interconnecting coaxial connectors of different sizes, the device comprising a metallic hollow support body, a plurality of coaxial connectors each comprising an outer socket element adapted to be fastened onto said support body and an inner pin element coaxially mounted in said socket element and electrically insulated therefrom, each pin element having a longitudinal axis, said support body comprising an outer wall surrounding an inner support body space and passageway through said outer wall opening into said inner space and each passageway adapted to allow the assembly of a coaxial connector onto said support body with the socket element of the respective coaxial connector being engaged in a respective passageway and a respective inner pin element extending through a respective passageway into said inner space and said pin element having an inner end in said inner space, the inner ends of all pin elements being electrically interconnected, the inner end of the pin element of one coaxial connector comprising a receiving pin element and terminating with a front face perpendicular to the axis of the pin element, the front face having a center recess extending from said front face axially inside said end and a plurality of holes extending radially through an end side wall surrounding said recess in a plane perpendicular to the axis of said pin element of said one coaxial connector, and said holes being angularly separated from one another, at least the inner end of the pin elements of the other coaxial connectors having a shape complementary to said radially extending holes, so that each inner end can be received in a radial hole, a passageway being provided in the outer wall of said support body in front of said recess to allow removable insertion into said recess of a means for properly positioning the inner ends of the pin elements of said other connectors within a respective radially extending hole for ensuring identical electric lengths of all connectors within the support body and allowing insertion of means for electrically connecting the inner ends of all connector pin elements within said recess.

2. A distributor device according to claim 1 wherein one connector is of larger size having a pin element comprising two axially aligned parts which may be assembled, the two parts comprising an outer part and an inner part, the inner part having one end engaged in said outer part and a free end shaped to receive the pin elements of the other connectors.

3. A device according to claim 1, wherein the means for electrically connecting the inner ends of the pin elements of the connectors is a welding agent applicable by means of a soldering iron insertable through said insertion passageway.

4. A distributor device according to claim 1, wherein the supporting body has a parallelepipedic shape and the connectors are each fastened onto one of the outer faces of the body while being orthogonally arranged with respect to each other, the holes for receiving the pin elements being formed of bores extending at right angles to the axis of the receiving pin element and intersecting on the axis of said recess.

5. A distributor device according to claim 4, wherein four connectors may be connected with their pin elements to said one receiving pin element.

6. A distributor device according to claim 4, wherein said center recess comprises an axial blind hole in the front face of the inner end of the one receiving pin element and the passageway for the insertion of the means for the electrical connection of the ends of the pin elements comprises a bore provided in a face of the supporting body which is located axially in front of said blind hole.

7. A distributor device according to claim 6, wherein the bore for inserting the connecting means is closed by a screw, the depth of penetration of which is adjustable and comprise a means for adjusting the electrical lengths of inner ways of the distributor.

8. A distributor device according to claim 1, wherein the one connector is of larger size, and further comprising at least one second connector of larger size, the inner end of the pin element of said second connector comprising an axial cylindrical end portion the diameter of which corresponds to the diameters of the pin elements of the connectors of smaller sizes so as to be engageable with one of said radially extending pin-receiving holes.

9. A distributor device according to claim 8, wherein one pin element of one connector of greater size comprises two axially aligned parts which may be assembled, the two parts comprising an outer electrical connection receiving part and one inner part having one end axially engaged in said outer part and a free end which carries said axial end portion.

10. A method of assembling a power distributing device adapted for interconnecting coaxial connectors of different sizes, the device comprising a metallic hollow support body, a plurality of coaxial connectors each comprising an outer socket element adapted to be fastened onto said support body and an inner pin element coaxially mounted in said socket element and electrically insulated therefrom, the pin elements each having a longitudinal axis, said support body comprising an outer wall surrounding an inner support body space and passageways through said outer wall opening into said inner space and each passageway adapted to allow the assembly of a coaxial connector onto said support body with a socket element of the respective coaxial connector being engaged in said passageway and the inner pin element extending through the passageway into said inner space and having an inner end in said inner space, the inner ends of all pin elements being electrically interconnected, the inner end of the pin element of one coaxial connector comprising a receiving pin element and terminating with a front face perpendicular to the axis of the respective pin element and the pin element having a center recess extending from said front face axially inside said end and a plurality of holes extending radially through the end side wall, surrounding said recess, in a plane perpendicular to said axis of said pin element of said one coaxial connector, and said holes being angularly separated from one another, at least the inner end of the pin elements of the other coaxial connectors having a shape complementary to said radially extending holes, so that each inner end can be received in a radial hole of the pin element of said one coaxial connector, a passageway being provided in the outer wall of said support body in front of said recess, the method comprising the steps of inserting into the center recess of the pin element receiving the pin elements of the other connectors a mounting rod, the diameter of the mounting rod being slightly smaller than the diameter of said recess, fitting the ends of the other pin elements into the radially extending receiving holes until they come into abutment against a side surface of the rod, fastening the pins in this position, inserting welding means through said passageway in front of the center recess and closing said passageway with a closing-off means by inserting said closing-off means in said passageway.

11. A method according to claim 10, comprising securing the pin elements in respective positions in abutment against the mounting rod by using a nut which may be screwed onto the connector of one pin element to be held against motion and carrying a central stud portion adapted to engage the outer end of the pin element.

* * * * *